US005890031A

United States Patent [19]

Yokota et al.

[11] Patent Number: 5,890,031

[45] Date of Patent: Mar. 30, 1999

[54] SAFETY DEVICE FOR A TONER IMAGE FIXING DEVICE

[75] Inventors: Shogo Yokota, Fujiidera; Toshiaki Kagawa; Toshihiro Tamura, both of Sakurai; Yoshiya Kinoshita, Ikoma-gun, all of Japan

[73] Assignee: Sharp Kabushiki Kaisha, Osaka, Japan

[21] Appl. No.: 771,533

[22] Filed: Dec. 23, 1996

[30] Foreign Application Priority Data

Dec. 26, 1995 [JP] Japan ..... 7-338844

[51] Int. Cl.[6] ..... G03G 15/20

[52] U.S. Cl. ..... 399/69; 73/866.5; 399/67; 399/33; 399/44

[58] Field of Search ..... 399/33, 44, 67, 399/69, 328; 219/216; 73/866.5; 374/153, 208

[56] References Cited

U.S. PATENT DOCUMENTS

| | | | |
|---|---|---|---|
| 3,357,249 | 12/1967 | Bernous et al. | 374/153 |
| 3,809,855 | 5/1974 | Neal | 219/216 |
| 4,441,827 | 4/1984 | Coderre | 374/153 |
| 4,951,096 | 8/1990 | Derimiggio et al. | 399/69 |
| 5,281,793 | 1/1994 | Gavin et al. | 219/216 |
| 5,299,870 | 4/1994 | Moritani | 374/153 |
| 5,366,291 | 11/1994 | Nakagama et al. | 374/153 |
| 5,475,200 | 12/1995 | Amico et al. | 219/216 X |

FOREIGN PATENT DOCUMENTS

| | | |
|---|---|---|
| 0 530 618 A1 | 3/1993 | European Pat. Off. . |
| 58-118681 | 7/1983 | Japan . |
| 63-169680 | 7/1988 | Japan . |

OTHER PUBLICATIONS

Patent Abstracts of Japan vol. 005, No. 046, 27 Mar. 1981 & JP 56 001324 A (Canon Inc.) 9 Jan. 1981.

Patent Abstracts of Japan vol. 014, No. 385, 20 Aug. 1990 & JP 02 145931 A (Hitachi Ltd.) 5 Jun. 1990.

*Primary Examiner*—Matthew S. Smith

*Attorney, Agent, or Firm*—David G. Conlin; George W. Neuner

[57] ABSTRACT

Energy saving in a fixing unit having a low heat capacity is achieved by reducing a loss of heat transferring from a temperature sensing element to temperature sensing unit and by improving response of the safety device. A heat-insulating member is formed to cover a temperature fuse being a temperature sensing element and a heat-conductive filler or heat-conductive elastic member is formed between the temperature fuse and a sliding sheet. A temperature sensing means having the temperature sensing element abuts on a fixing roller through a sliding sheet interposed therebetween. A contacting portion of the temperature sensing means with the heat-insulating member and the filler or elastic member has a curved contacting surface fitting a cylindrical surface of the fixing roller. The heat-insulating member has a groove or a slit for engaging with a protrusion of the temperature sensing element to be secured to the heat-insulating member.

17 Claims, 7 Drawing Sheets

SAFETY DEVICE FOR A TONER IMAGE FIXING DEVICE

BACKGROUND OF THE INVENTION

Toner image fixing devices used in electro-photographic type copying machines, facsimiles, printers and other instruments using electro-photographic process are generally of the thermal fixing type that fixes toner image on a recording medium by fusing. A fixing portion is composed of a Eli; fixing roller and pressure roller pressing the fixing roller. Either one or both rollers are heated. While the recording member passes a nip between the two rollers, a toner image formed on the recording member is fixed thereon by the effect of heat and pressure.

The fixing roller is a thin-wall aluminum cylinder coated with well-releasable and heat-resistant synthetic resin, e.g., fluorocarbon resin (PFA, PTFE), and includes a heater lamp inserted in its center bore. The fixing roller is rotatably supported on a roller supporting member.

The pressure roller is a metal roller coated with silicone rubber and is rotatably supported at both ends by a pair of pressure-roller supporting members. The pressure roller is pressed against the fixing roller at a constant force of compression coiled springs.

The surface of the fixing roller is heated by the heater lamp mounted therein. Surface temperature of the fixing roller is controlled by a temperature adjusting circuit according to a signal from a roller-surface-temperature sensing means disposed near the fixing roller. The roller-surface-temperature sensing means comprises a temperature sensing element (e.g., thermistor) pressed against the surface of the fixing roller to minimize a disturbance.

While the recording medium carrying a toner image formed thereon passes through a nip formed between the fixing roller and the pressure roller, the toner image is heated and fixed by fusing onto the recording member. Thus, the fixing portion has heating means for heating and keeping the roller surface at a constant temperature to fuse toner on the recording medium. Accordingly, the temperature of the roller surface may abnormally rise if the roller-surface temperature control malfunctions due to abnormal operation of a main machine. The machine is provided with a safety device that may prevent occurrence of smoke and fire in the machine in the worst case.

The safety device may be composed of a separate temperature sensing means and a separate control circuit or the temperature sensing means inserted in series in the heater lamp circuit. The safety device detects by the temperature sensing means that a temperature of the roller exceeds a specified value. It acts upon the control circuit to stop power supply to the heater lamp or directly switches off the heater lamp circuit. A temperature sensing element (e.g., a thermostat, a temperature fuse and a thermal protector) is usually used as means for sensing an abnormally rising temperature. This temperature sensing element is usually disposed apart from the roller since the roller surface temperature rises gradually.

Recently, electro-energy saving of electric appliances has become a very important problem from the environmental view point. Electrophotographic type printers and other machines that use electrophotographic process are also required to be of electro-energy-saving type. A most energy consuming portion of an electrophotographic machine (printer) is a toner-image fixing device that consumes a large part of a total electric power consumption of the machine. The reduction of power consumption of the fixing device is an essential object of the electrophotographic machine.

It is, however, very difficult to reduce the power consumption of the conventional fixing device without changing its construction. The reason is as follows:

Once switched on, the conventional fixing device keeps its roller at a constant temperature even while print is not needed. Preheating of the roller is necessary for printing without waiting time.

It is therefore possible to reduce power consumption of the fixing device by switching off the heater except for printing time. However, this solution encounters a new problem that every time before printing it is required to wait until the roller gets a temperature necessary for fixing toner image.

Methods which are thought effective to solve this new problem "increased waiting time" are: (1) increasing wattage of a heater lamp and (2) reducing a diameter or wall thickness of a fixing roller. The method (1) is simple but not practical because waiting time can be shortened but electric power consumption is increased. The method (2) is to make the roller be quickly heated up by reducing its heat capacity and thereby shorten the waiting time. This method is also simple but involves the following problem:

The fixing roller of a reduced heat-capacity can be so rapidly heated up that the conventional temperature sensing element can not response to a change of surface temperature of the roller. This means that abnormal temperature rising may not immediately detect, causing smoke and fire in the machine. So, practical use of an energy-saving fixing device of a small heat capacity has not been realized because the safety operation can not be guaranteed.

On the other hand, response of temperature sensing elements have been improved. Japanese Laid-Open Patent Publication No. 58-118681 discloses such a method that a temperature sensing element is disposed apart from a roller and a heat-reflector is disposed behind the temperature sensing element to increase a sensing surface temperature of the element. Japanese Laid-Open Patent Publication No. 63-169680 discloses a temperature sensing element covered with a heat-conductive member, which butts upon a roller.

The above-mentioned methods can be effectively applied to the conventional fixing unit which temperature rises moderately but can not be applied to a small-heat-capacity type fixing device that may realize considerable reduction of electric power consumption. For example, the art described in Japanese Laid-Open Patent Publication No. 58-118681 can not realize the small-heat-capacity type fixing unit because a temperature sensing portion of a safety device having no contact with a fixing roller may cause a large disturbance and has an insufficient response resulted from low heat-conductivity. The prior art disclosed in Japanese Laid-Open Patent Publication No. 63-169680 can not be applied to a small-heat-capacity type fixing unit because the temperature sensing element covered with aluminum block has a worse response due to large heat transfer and the temperature sensing element covered with teflon has a worse response due to low heat-conductivity.

SUMMARY OF THE INVENTION

The present invention relates to a safety device for a toner image fixing device used in an electrophotographic process device such as an electrophotographic copying machine, electrophotographic facsimile, electrophotographic printer and so on.

The present invention relates to improvements of response of a temperature sensing unit of a safety device for sensing abnormal temperature rise of a fixing portion.

To achieve the above-mentioned object, a safety device of a fixing unit according to the present invention provides: a safety device of a toner image fixing unit, which has a fast-response temperature sensing unit that includes a small heat-capacity type temperature sensing element (e.g., a temperature fuse, small-size thermostat, thermal protector and so on) and is in contact with a fixing roller through a sliding sheet. A filler or elastic member having good heat conductivity may be interposed between the temperature sensing unit and the sliding sheet to reduce a loss of heat transfer.

The temperature sensing element is covered at its not-contacting surface (reverse to a surface contacting with a sliding sheet) with a heat-insulating member preventing heat liberation. The heat-insulating member has a groove or a notch for engaging a protrusion of the temperature sensing element to fix the element and improve contact of the temperature sensing unit with the fixing roller.

Furthermore, the contacting surface of the temperature sensing unit is formed to have the same curvature that the cylindrical surface of the fixing roller has by means of the insulating member and the filler or elastic member.

PREFERRED EMBODIMENT OF THE INVENTION

Prior to explaining preferred embodiments of the present invention, prior art safety device will be described below as references for the present invention.

Figure 1:
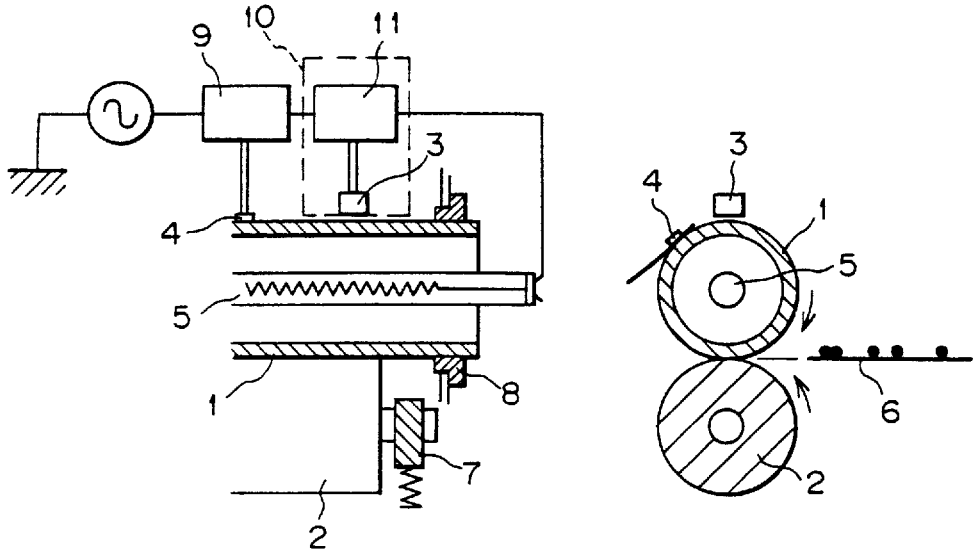
FIG.1 ( PRIOR ART )
FIG. 1 is a schematic construction view of a conventional toner-image fixing device.

FIG. 1 is a schematic construction view of a conventional toner-image fixing device. A fixing portion is composed of a fixing roller 1 and pressure roller 2 pressing the fixing roller. Either one or both rollers are heated. While the recording member 6 passes a nip between the two rollers, a toner image formed on the recording member 6 is fixed thereon by the effect of heat and pressure.

The fixing roller 1 is a thin-wall aluminum cylinder coated with well-releasable and heat-resistant synthetic resin, e.g., fluorocarbon resin (PFA, PTFE), and includes a heater lamp 5 inserted in its center bore. The fixing roller is rotatably supported on a roller supporting member 8.

The pressure roller 2 is a metal roller coated with silicone rubber and is rotatably supported at both ends by a pair of pressure-roller supporting members 7. The pressure roller 2 is pressed against the fixing roller 1 at a constant force of compression coiled springs.

The surface of the fixing roller 1 is heated by the heater lamp 5 mounted therein. Surface temperature of the fixing roller is controlled by a temperature adjusting circuit 9 according to a signal from a roller-surface-temperature sensing means 4 disposed near the fixing roller 1. The roller-surface-temperature sensing means 4 comprises a temperature sensing element (e.g., thermistor) pressed against the surface of the fixing roller to minimize a disturbance.

While the recording medium 6 carrying a toner image formed thereon passes through a nip formed between the fixing roller and the pressure roller, the toner image is heated and fixed by fusing onto the recording member 6. Thus, the fixing portion has heating means for heating and keeping the roller surface at a constant temperature to fuse toner on the recording medium. Accordingly, the temperature of the roller surface may abnormally rise if the roller-surface temperature control malfunctions due to abnormal operation of a main machine. The machine is provided with a safety device 10 that may prevent occurrence of smoke and fire in the machine in the worst case.

The safety device 10 may be composed of a separate temperature sensing means 3 and a separate control circuit 11 as shown in FIG. 1 or the temperature sensing means 3 inserted in series in the heater lamp circuit. The safety device 10 detects by the temperature sensing means 3 that a temperature of the roller exceeds a specified value. It acts upon the control circuit 11 to stop power supply to the heater lamp or directly switches off the heater lamp circuit. A temperature sensing element (e.g., a thermostat, a temperature fuse and a thermal protector) is usually used as means for detecting an abnormally rising temperature.

The present invention relates to improvements of response of a temperature sensing unit of a safety device for sensing abnormal temperature rise of a fixing portion.

Referring now to the accompanying drawings, preferred embodiment of the present invention, which uses a temperature fuse, will be described below in detail.

Figure 2:
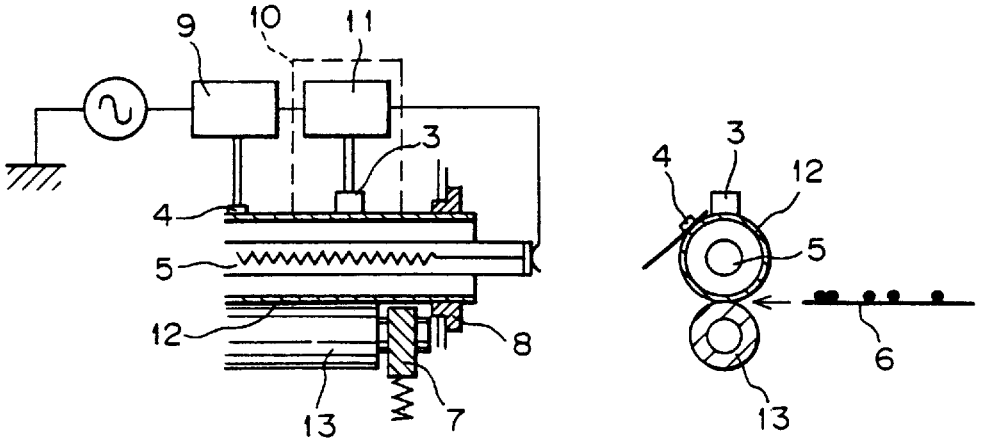
FIG. 2 is a schematic construction view of a toner-image fixing device to which a safety device according to the present invention is applied.

FIG. 2 shows a construction of a fixing portion of a toner image fixing device using a safety device according to the present invention. The safety device is explained later in detail. The structure of a small heat-capacity fixing device and temperature rising characteristics of the device must be first described as follows:

A fixing roller 12 is a small heat-capacity type whose inside diameter is 13 mm and wall thickness is 0.5 mm (a conventional fixing roller has an inside diameter of not less than 20 mm and a wall thickness of not less than 1.5 mm). The cylindrical surface of the fixing roller 12, like the conventional roller, is covered with a coat of synthetic resin that has good releasing and heat resistant properties. The roller 12 contains therein a heater lamp 5 whose rated power is 400 W (800 W in the conventional device because of a large heat-capacity of the roller to be heated). A pressure roller 13 is a silicon rubber roller having an shaft made of metal whereto the silicon rubber is secured. The pressure roller 13 has a small diameter of 12 mm to attain a reduced heat-capacity (the conventional roller has a diameter of not less than 20 mm).

Figure 6B:
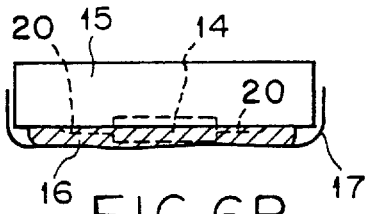
FIG. 6(*a*)–6(*c*) schematically illustrate another structure of a temperature sensing portion of a safety device according to the present invention.
Figure 6C:
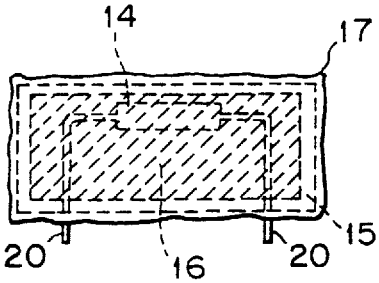
Figure 6A:
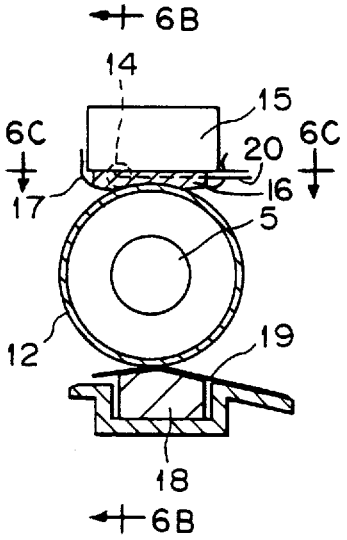

There is a method for further reducing heat-capacity of the fixing device by using a pressure member 18 shown in FIG. 6 in place of the pressure roller 13. The pressure member 18 is made of an elastic material having an excellent heat resistance. Namely, an elastic member for pressing a recording medium against the fixing roller 12 is not rotatable but fixed so as to reduce mass of the pressure member, thus minimizing heat-transfer from the fixing roller. The pressure member 18, however, is inferior in paper feeding ability to the pressure roller, and its surface is therefore covered with a pressure sheet 19 that can reduce a friction force on the recording material 6 to be smaller than a friction force between the recording material 6 and the fixing roller 1. The recording material 6 is fed forward by the effect of a differential friction force.

Figure 3:
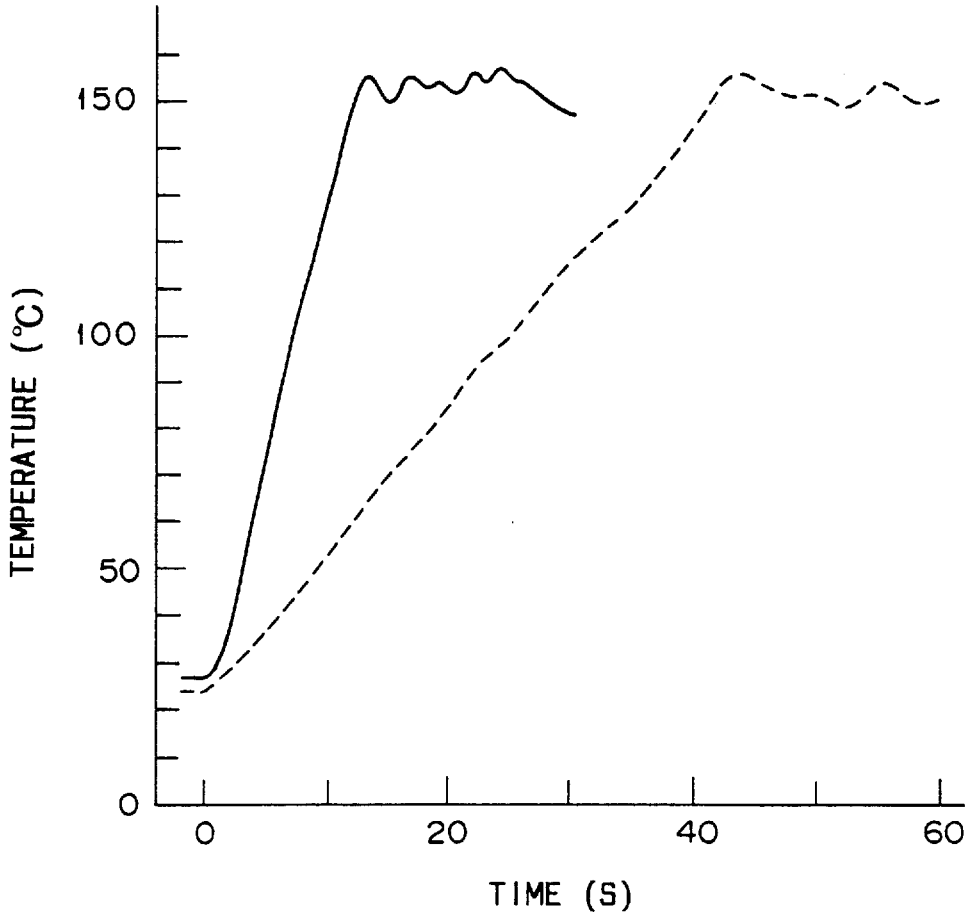
FIG. 3 is a graph showing an increasing surface temperature of a fixing roller.

The surface temperature rising characteristic of the fixing roller in the above-mentioned fixing device that uses the pressure member (FIG. 6) instead of the pressure roller 13 is studied as follows:

The surface temperature of the fixing roller is measured and the measurement result is shown in FIG. 3. The temperature characteristic curve shown indicates the fixing roller surface temperature changing with time on the condition that the roller surface temperature control is normally performed. In FIG. 3, a solid-line curve shows the change of the roller surface temperature of the fixing device relating to the present invention and a broken-line curve shows the change of the roller surface temperature of the conventional fixing unit.

In FIG. 3, the time interval during which the roller surface temperature rises from a room temperature to a temperature necessary for fixing toner image (usually 150° C.) is termed the rising time. It is apparent that the rising time of the embodiment as compared with the rising time (40–50 seconds) of the conventional unit is considerably shortened to 10–12 seconds. Consequently, printing can start with a shortest waiting time without heating the roller while no print is made. However, the fixing device having a so much reduced heat-capacity may involve the previously mentioned danger that the fixing roller so fast heated over the limited value, generating smoke and fire in the fixing device.

Figure 4:
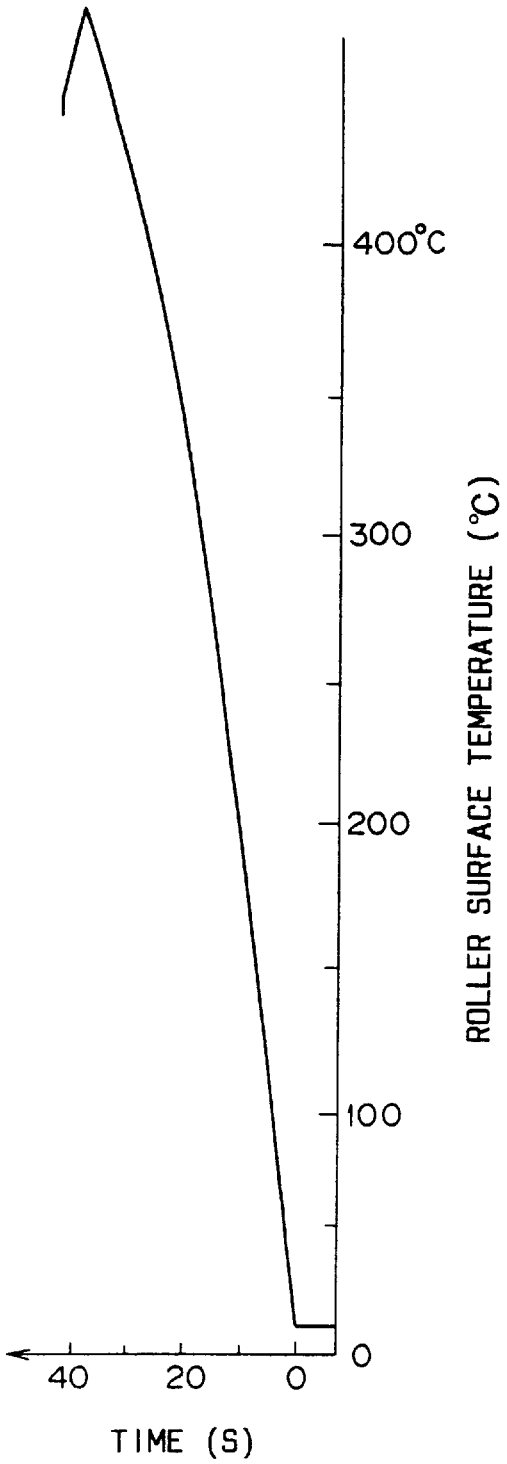
FIG. 4 is a graph showing an abnormally increasing surface temperature of a fixing roller.

FIG. 4 shows the roller surface temperature of the fixing device in an abnormal condition. As shown in FIG. 4, the roller surface temperature exceeds 400° C. for 20–30 seconds after switching ON the heater lamp. The shown temperature curve is obtained in the fixing device with a temperature fuse (temperature sensing element) disposed apart by 5 mm from the roller surface. In this case, the temperature fuse did not act when the roller surface temperature increased over 450° C. It is very dangerous since the firing point of paper is 430° C.–450° C. (namely, a recording paper sheet may get be set on fire when passing the nip portion of the roller). Accordingly, the conventional safety device can not realize a power-saving fixing device having a small heat capacity.

Figure 5B:
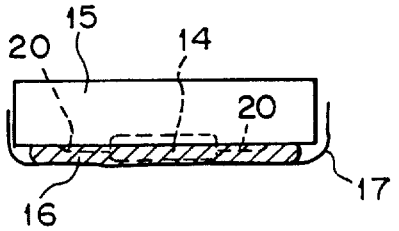
FIG. 5(*a*)–5(*c*) schematically illustrate a structure of a temperature sensing portion of a safety device according to the present invention.
Figure 5C:
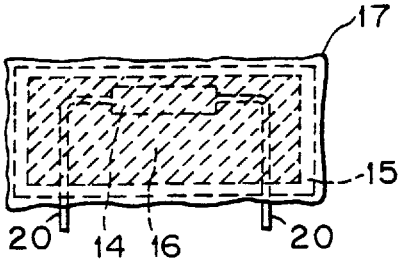
Figure 5A:
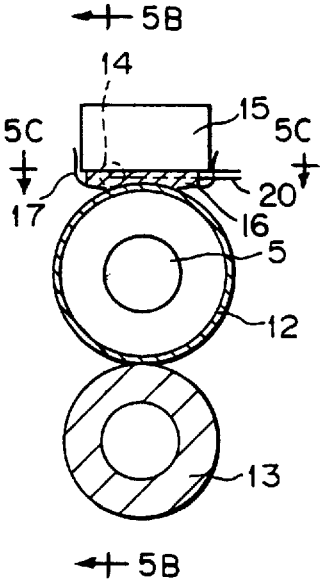

Referring to FIGS. 5(*a*) through 6(*c*) the structure of a temperature sensing portion of a safety device according to the present invention is described as follows:

FIGS. 5(*a*) and 6(*a*), respectively, each show a view of the temperature sensing portion taken along the line AA of FIGS. 5(*c*) and 6(*c*), respectively. A temperature fuse 14 has lead wires 20 disposed at each end of said fuse, as is shown in FIGS. 5(*b*) and 6(*b*). The temperature fuse 14 is secured onto a heat-insulating member 15 that is made of heat-resistant silicon sponge manufactured by INOAC company (in the shown case). This heat-insulating member 15 is preferred to be elastic because its contact surface on a roller may be increased. In principle, any material having heat-insulating ability may be used. Engineering resin (e.g., polycarbonate resin) and heat-resistant resin can be also applied. The heat-insulating member 15 has a groove or a slit (not shown) that accepts the shape of a protruding portion of the temperature fuse 14 so that the temperature sensing portion of the temperature fuse 14 is reliably abutted on a fixing roller 12 and the temperature fuse 14 itself is accurately located. The heat-insulating member 15 is supported at the opposite side (reverse to the surface facing to the fixing roller) by springs or ribs (not shown). Namely, the temperature sensing means 3 (FIG. 2) is abutted against the fixing roller 12 by spring forces and/or by the effect of the elasticity of the heat-insulating member.

FIGS. 5(*a*) through 5(*c*) and 6(*b*) through 6(*c*) illustrate how the temperature fuse 14 is surrounded tightly by a heat-conductive filler 16 and heat insulating member 15, thus eliminating an air layer preventing heat-transfer. In the shown case, heat-resistant silicon rubber K3493 made by Shin-etsu Chemical Industry also can be used. It is also possible to use an elastic material having heat conductivity, isolation, and heat resistance properties for the filler 16.

FIGS. 5(*b*) and 6(*b*), each taken along the reference lines BB of FIGS. 5(*c*) and 6(*c*), respectively, show how the sliding sheet 17 is interposed between the filler 16 and the fixing roller to prevent the roller surface from wearing. In the shown embodiment the sliding sheet 17 is a Kapton sheet of 25 $\mu$m made by Toray-Doupon Company. A sheet of Teflon also may be used. As FIGS. 5(*c*) and 6(*c*) illustrate, the fixing roller 12 and the sliding sheet 17 make a facial (not line) contact with each other by the effect of the filler 16 and the heat-insulating member 15.

Figure 7:
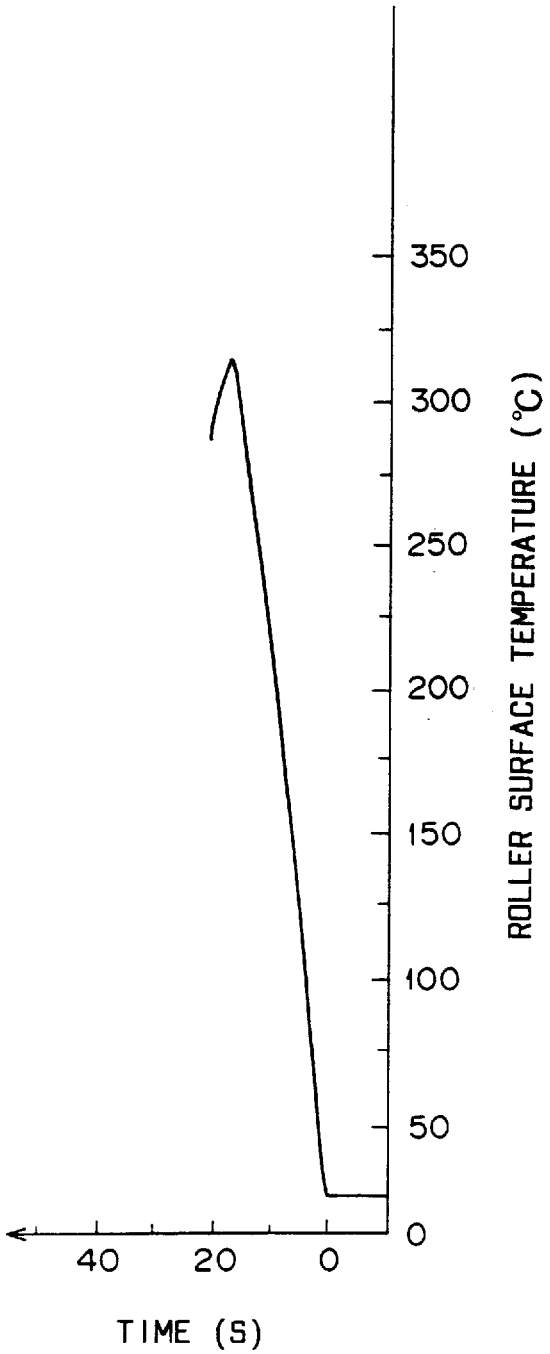
FIG. 7 is a graph showing a working condition of a safety device when a surface temperature of a fixing roller abnormally rises.

FIG. 7 shows the effect of applying the safety device in the small-heat-capacity type fixing device. A curve shown in FIG. 7 indicates the roller surface temperature changing with time under an abnormal condition. As is apparent from FIG. 7, the safety device can act and forcibly extinguish the heater lamp at 325° C. (fairly lower than the firing point of paper) when for some reason or other the heater lamp is left burning. There is no fear of smoking or firing in an unusual condition. Accordingly, the small heat-capacity type fixing device with the safety device can be safely used.

Although the shown embodiment uses heat-resistant silicon rubber as the filler, heat-conductive and heat-resistant gel substance may be used instead of the silicon rubber.

As is apparent from the foregoing, the safety device of the toner fixing device according to the present invention offers the following advantages:

Since the temperature sensing unit is formed of a small heat-capacity temperature sensing element and the sliding sheet with heat-conductive filler or heat-conductive elastic body interposed therebetween and the temperature sensing element is abutted through the sliding sheet on the fixing roller, the heat transfer loss between the roller and the temperature sensing portion is reduced and the heat flow to the temperature sensing portion of the temperature sensing element is improved, thus an increased response of the safety device is attained.

The temperature sensing element is covered with the heat-insulating member that prevents heat-transfer from the element surface reverse to the surface contacting with the roller surface, thus the heat-transfer to the temperature sensing portion of the temperature sensing element is improved and an increased response of the safety device is attained.

The contacting surface of the temperature sensing unit is formed to have the same curvature as the fixing roller has by using the heat-insulating member, heat-conductive filler or elastic member: the contacting area of the temperature sensing unit can be increased and the heat-transfer ratio is thereby improved, thereby the safety device attains fast response.

Furthermore, the heat-insulating member of the temperature sensing unit has a groove or a slit wherein the protruding portion of the temperature sensing element fit. Namely, the temperature sensing element can be correctly positioned relative to the fixing roller and its temperature sensing portion can keep smooth contact with the roller surface.

We claim:

1. A safety device for detecting an abnormal increase of temperature of a toner image fixing roller and cutting off power supply to a heating means for a toner image fixing device, the safety device comprising:

a small temperature sensing element having a small heat capacity and lead wires connected to both ends of the temperature sensing element to detect temperature;

a sliding sheet abutting the fixing-roller and temperature sensing element; and a heat-conductive material, wherein said heat-conductive material is interposed between the sliding sheet and said temperature sensing element and at least a portion of the lead wires, and wherein said heat-conductive material is in contact with said temperature sensing element and apart of the lead wires, said safety device further comprising a heat insulating member positioned on a side of the temperature sensing element opposite the sliding sheet wherein the temperature sensing element and a portion of the lead wires are covered opposite to the fixing roller by an insulating material, and wherein the lead wires are disposed at a location chosen from the group consisting of (i) a boundary between the heat insulating member and the heat conductive material and (ii) the surface of the heat insulating member.

2. A safety device for a toner-image fixing device as defined in claim 1, wherein the insulating member is positioned at a location chosen from the group consisting of (i) abutting the sliding sheet and temperature sensing element and (ii) abutting the sliding sheet, the heat conductive material, the temperature sensing element, and a portion of the lead wires.

3. A safety device for a toner-image fixing device as defined in claim 2, wherein the heat insulating member has an opening for supporting the temperature sensing element, said opening chosen from the group consisting of (i) a groove and (ii) a slit.

4. A safety device for a toner image fixing device as defined in claim 3, further comprising a surface having a curvature corresponding to and abutting a curved portion of the external surface of the fixing roller.

5. A safety device for a toner image fixing device as defined in claim 2, further comprising a surface having a curvature corresponding to and abutting a curved portion of the external surface of the fixing roller.

6. A safety device for a toner-image fixing device as defined in claim 1, wherein the heat insulating member has an opening for supporting the temperature sensing element, said opening chosen from the group consisting of (i) a groove and (ii) a slit.

7. A safety device for a toner image fixing device as defined in claim 6, further comprising a surface having a curvature corresponding to and abutting the external surface of the fixing roller.

8. A safety device for a toner image fixing device as defined in claim 1, further comprising a surface having a curvature corresponding to and abutting a curved portion of the external surface of the fixing roller.

9. A safety device for detecting an abnormal increase of temperature of a toner image fixing roller and cutting off power supply to a heating means for a toner image fixing device, the safety device composing:

a small temperature sensing element having a small heat capacity lead wires connected to both of the temperature sensing element to detect temperature;

a sliding sheet abutting the fixing-roller and temperature sensing element; and a heat-conductive material, wherein said heat-conductive material is interposed between the sliding sheet and said temperature sensing element and at least a portion of the lead wires, and wherein said heat-conductive material is in contact with said temperature sensing clement and a portion of the lead wires, wherein said heat-conductive material completely fills a space between the sliding sheet, the temperature sensing element and a portion of the lead wires to from a tight structure of the sliding sheet, the temperature sensing element and the portion of the lead wires, said safety device further comprising a heat insulating member positioned on a side of the temperature sensing element opposite the sliding sheet wherein the temperature sensing element and a portion of the lead wires are covered opposite to the fixing roller by a insulating material, and wherein the lead wires are disposed at a location chosen from the group consisting of (i) a boundary between the heat insulating member and the heat conductive material and (ii) the surface of the heat insulating member.

10. A safety device for a toner-image fixing device as defined in claim 9, wherein the heat insulating member is positioned at a location chosen from the group consisting of (i) abutting the sliding sheet and temperature sensing element and (ii) abutting the sliding sheet, the heat conductive material, the temperature sensing element, and a portion of the lead wires.

11. A safety device for a toner-image fixing device as defined in claim 10, wherein the heat insulating member has an opening for supporting the temperature sensing element, said opening chosen from the group consisting of (i) a groove and (ii) a slit.

12. A safety device for a toner image fixing device as defined in claim 11, further comprising a surface having a curvature corresponding to and abutting a curved portion of the external surface of the fixing roller.

13. A safety device for a toner image fixing device as defined in claim 10, further comprising a surface having a curvature corresponding to and abutting a curved portion of the external surface of the fixing roller.

14. A safety device for a toner-image fixing device as defined in claim 9, wherein the heat insulating member has an opening for supporting the temperature sensing element, said opening chosen from the group consisting of (i) a groove and (ii) a slit.

15. A safety device for a toner image fixing device as defined in claim 14, further comprising a surface having a curvature corresponding to and abutting a curved portion of the external surface of the fixing roller.

16. A safety device for a toner image fixing device as defined in claim 9, further comprising a surface having a curvature corresponding to and abutting a curved portion of the external surface of the fixing roller.

17. A safety device for detecting an abnormal increase of temperature of a toner image fixing roller and cutting off power supply to a heating means for a toner image fixing device, the safety device comprising:

a small temperature sensing element having a small heat capacity and lead wires connected to both ends of the temperature sensing element to detect temperature;

a sliding sheet abutting the fixing-roller and temperature sensing element;

a heat-conductive material;

a heat insulating member positioned on a side of the temperature sensing element opposite the sliding sheet; and a surface having a curvature corresponding to and abutting a curved portion of the external surface of the fixing roller;

wherein the temperature sensing element and a portion of the lead wires are covered opposite to the fixing roller by the heat insulating member, wherein the lead wires are disposed at a location chosen from the group consisting of (i) a boundary between the heat insulating member and the heat conductive material and (ii) the surface of the heat insulating member;

wherein said heat-conductive material is interposed between the sliding sheet and said temperature sensing element and at least a portion of the lead wires, wherein said heat-conductive material completely fills a space between the sliding sheet, the temperature sensing element and a portion of the lead wires to form a tight structure of the sliding sheet, the temperature sensing element and the portion of the lead wires, and wherein said heat-conductive material is in contact with said temperature sensing element and a portion of the lead wires.

* * * * *